US008940468B2

(12) United States Patent
Aoki et al.

(10) Patent No.: US 8,940,468 B2
(45) Date of Patent: Jan. 27, 2015

(54) DECOLORABLE TONER AND PROCESS FOR PRODUCTION THEREOF

(75) Inventors: Takayasu Aoki, Shizuoka-ken (JP); Takafumi Hara, Shizuoka-ken (JP); Tsuyoshi Itou, Shizuoka-ken (JP); Masahiro Ikuta, Shizuoka-ken (JP); Motonari Udo, Shizuoka-ken (JP); Koji Shimokusa, Wakayama-ken (JP); Hiroshi Mizuhata, Wakayama-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 42 days.

(21) Appl. No.: 13/537,451

(22) Filed: Jun. 29, 2012

(65) Prior Publication Data

US 2013/0011777 A1 Jan. 10, 2013

(30) Foreign Application Priority Data

Jul. 8, 2011 (JP) ..... 2011-151351

(51) Int. Cl.

| | |
|---|---|
| ***G03G 9/00*** | (2006.01) |
| ***G03G 9/09*** | (2006.01) |
| ***G03G 9/087*** | (2006.01) |

(52) U.S. Cl.

CPC ..... *G03G 9/0928* (2013.01); *G03G 9/08755* (2013.01); *G03G 9/08793* (2013.01); *G03G 9/0926* (2013.01)

USPC ..... 430/110.2; 430/105; 430/108.4; 430/109.4; 430/119.2; 430/123.57; 430/123.54; 430/137.11; 430/137.12; 430/134.14

(58) Field of Classification Search

CPC ..... G03G 9/0808; G03G 9/08742; G03G 9/08755; G03G 9/08764; G03G 9/0906; G03G 9/093; G03G 9/09364; G03G 9/09758

USPC ..... 430/105, 108.4, 109.4, 110.2, 119.2, 430/123.57, 124.54, 137.11, 137.12, 137.14

See application file for complete search history.

(56) References Cited

U.S. PATENT DOCUMENTS

| | | | | |
|---|---|---|---|---|
| 5,080,992 | A * | 1/1992 | Mori et al. | 430/110.1 |
| 5,849,456 | A | 12/1998 | Matsumura et al. | |
| 8,023,858 | B2 | 9/2011 | Shinoda | |
| 8,409,775 | B2 | 4/2013 | Suzuki et al. | |
| 8,475,993 | B2 | 7/2013 | Ikuta | |
| 2007/0258727 | A1 | 11/2007 | Shinoda | |
| 2010/0183969 | A1* | 7/2010 | Suzuki et al. | 430/108.2 |
| 2010/0209839 | A1* | 8/2010 | Kabai et al. | 430/110.2 |
| 2011/0123923 | A1 | 5/2011 | Ikuta | |
| 2011/0262850 | A1* | 10/2011 | Itou et al. | 430/105 |

FOREIGN PATENT DOCUMENTS

| | | |
|---|---|---|
| CN | 101067734 | 11/2007 |
| CN | 101796102 | 8/2010 |
| CN | 102073228 | 5/2011 |
| EP | 0980028 | 2/2000 |
| EP | 2219081 | 8/2010 |
| EP | 2325700 | 5/2011 |
| JP | P3457538 | 8/2003 |
| JP | 2004-163854 | 6/2004 |
| JP | P4204360 | 10/2008 |
| JP | 2010-48954 | 3/2010 |
| JP | 2010-78828 | 4/2010 |

OTHER PUBLICATIONS

Notification of the First Office Action for Chinese Patent Application No. 201210236211.6 Dated Dec. 3, 22, 2013, 22 pgs.

* cited by examiner

*Primary Examiner* — Thorl Chea

(74) *Attorney, Agent, or Firm* — Amin, Turocy & Watson, LLP

(57) ABSTRACT

Disclosed is a process for production of a decolorable toner, including: aggregating dispersed fine particles of a color material comprising at least a color-forming compound, a color-developing agent and a decoloring agent with dispersed fine particles comprising at least a binder resin comprising a polyester resin to form aggregates in an aqueous medium, adding a reactive polymer having an oxazoline group in to the aqueous medium, and fusing the aggregates in the aqueous medium. As a result, it becomes possible to produce a decolorable toner which suppresses the generation of fine powder due to the release of fine particles of an erasable color material from the toner.

7 Claims, 4 Drawing Sheets

DECOLORABLE TONER AND PROCESS FOR PRODUCTION THEREOF

CROSS-REFERENCE TO RELATED APPLICATIONS

This application is based upon and claims the benefit of priority from Japanese Patent Application No. 151351/2011, filed Jul. 8, 2011; the entire contents of which are incorporated herein by reference.

FIELD

Embodiments described herein relate generally to a toner, particularly a decolorable or erasable toner and a process for production thereof.

BACKGROUND

Due to the widespread use of computer, software and network, it has become possible to accelerate and share information processing. Fundamentally, digitization of information is suited for storage, accumulation, retrieval, etc. of information, whereas a paper medium is suited for display (particularly viewability) and transfer of information. It is therefore a present state that as digitization of information progresses, the consumption of paper is increasing. On the other hand, reduction of energy consumption represented by $CO_2$ emission is an urgent need in various fields. If a paper medium which is used for temporary display or transfer of information can be recycled, a great contribution can be made to the reduction of energy consumption. There is a method in which a color is developed and erased by heating using a reversible heat-sensitive recording medium. However, in this method, a color-forming composition is present on a recording medium, and therefore, the method has a disadvantage that a common paper medium cannot be used. There is also known to produce an erasable toner by a pulverization method. However, the erasable toner has a disadvantage that in a process of melt-kneading components such as a color-forming agent, a color-developing agent and a decoloring agent, the components are reacted with each other, so that the density of the developed color is decreased and also a decoloring reaction rate is decreased. As a production method other than the kneading pulverization method, a production, method employing a wet process in which a toner is obtained by aggregating and fusing fine particles of an erasable color material and fine particles of a binder resin, etc. in an aqueous medium has also been proposed. According to this method, it is possible to mix the fine particles of the erasable color material with the binder resin, etc. to effect coalescence without being subjected to mechanical shearing or high thermal history by melt-kneading. However, in this method, it is difficult to completely incorporate the fine particles of the color material in a toner, and this method has been found to provide a problem that the fine particles of the color material released from the toner remain in the toner as fine powder to cause an image defect such as fogging. This tendency is particularly pronounced when the fine particles of the color material are microencapsulated.

On the other hand, it has been proposed that by crosslinking a toner resin using a reactive polymer, the fixability, thermal characteristics and mechanical characteristics of a toner are mainly improved.

DETAILED DESCRIPTION

Figure 1:
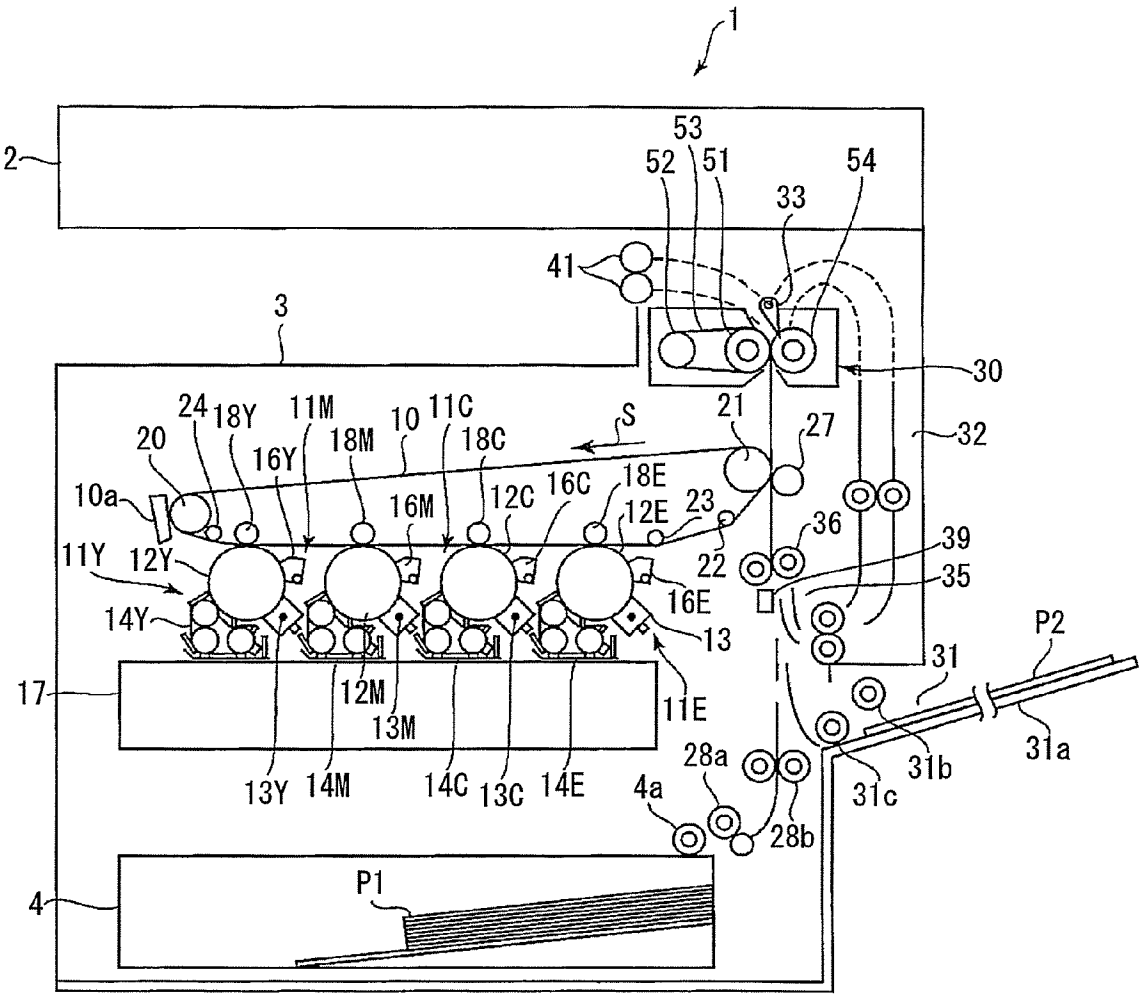
FIG. 1 is an overall arrangement view showing an image forming apparatus to which a developer according to an embodiment is applicable.

Embodiments described herein aim at allowing the production of a decolorable toner which suppresses the generation of fine powder due to the release of fine particles of an erasable color material from the toner.

An embodiment described herein provides a decolorable toner, comprising a binder resin comprising a polyester resin, a color-forming compound, a color-developing agent, and a decoloring agent; and also having a crosslink coating formed by reacting the binder resin with a polymer having an oxazoline group reactive with the polyester resin.

Another embodiment described herein provides a process for production of a decolorable toner, comprising: aggregating dispersed particles of a color material comprising at least a color-forming compound, a color-developing agent and a decoloring agent with dispersed particles comprising at least a binder resin comprising a polyester resin to form aggregates in an aqueous medium, adding a reactive polymer having an oxazoline group into the aqueous medium, and fusing the aggregates in the aqueous medium.

Hereinafter, embodiments will be described. In the following description, "part(s)" and "%" representing a composition are expressed by weight unless otherwise specified.

(Binder Resin)

A binder resin used in an embodiment is a polyester resin capable of crosslinking with an oxazoline group of a reactive polymer which will be described later. Particularly, a polyester resin obtained by subjecting a dicarboxylic acid component and a diol component to esterification accompanied with polycondensation, is preferred. Examples of the acid component include aromatic dicarboxylic acids, such as terephthalic acid, phthalic acid and isophthalic acid; and aliphatic carboxylic acids, such as fumaric acid, maleic acid, succinic acid, adipic acid, sebacic acid, glutaric acid, pimelic acid, oxalic acid, malonic acid, citraconic acid and itaconic acid.

Examples of the alcohol component include aliphatic diols, such as ethylene glycol, propylene glycol, 1,4-butanediol, 1,3-butanediol, 1,5-pentanediol, 1,6-hexanediol, neopentyl glycol, trimethylene glycol, trimethylolpropane and pentaerythritol; alicyclic diols, such as 1,4-cyclohexanediol and 1,4-cyclohexanedimethanol; and ethylene oxide adducts or propylene oxide adducts of bisphenol A, etc.

Further, the above polyester component may be converted so as to have a crosslinked structure by using a trivalent or higher polyvalent carboxylic acid component or a trihydric or higher polyhydric alcohol component, such as 1,2,4-benzenetricarboxylic acid (trimellitic acid) or glycerin.

The polyester resin may be crystalline or amorphous, but is preferably amorphous.

Two or more species of polyester resins having different compositions can be mixed and used, and it is sometimes preferred to use two or more species of polyester resins in admixture. It is particularly preferred to use two or more species of amorphous polyester resins in admixture.

The glass transition temperature of the polyester resin is preferably 45° C. or higher and 70° C. or lower, and more preferably 50° C. or higher and 65° C. or lower. A polyester resin having a glass transition temperature lower than 35° C. is undesirable because the heat-resistant storage stability of the toner is deteriorated, and further, gloss derived from the resin after erasure becomes noticeable. A polyester resin having a glass transition temperature higher than 70° C. is not preferred because the low-temperature fixability is deteriorated, and also the erasability on heating becomes poor. From the viewpoint of crosslinkability with an oxazoline group and ease of emulsification, a polyester resin having an acid value of from 5 to 35 mgKOH/g, particularly from 15 to 35 mgKOH/g, is preferred.

(Color-Forming Compound)

The color-forming compound is an electron-donating precursor of a pigment for use in expressing characters, figures, etc. As an electron-donating color-forming agent, a leuco dye may be mainly used. The leuco dye is an electron-donating compound capable of forming a color by the action of the color-developing agent. Examples thereof include diphenylmethane phthalides, phenylindolyl phthalides, indolyl phthalides, diphenylmethane azaphthalides, phenylindolyl azaphthalides, fluorans, styrynoquinolines and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds and bisquinazoline compounds. These compounds can also be used by mixing two or more species thereof.

(Color-Developing Agent)

The color-developing agent is an electron-accepting compound which causes the color-forming agent to develop a color by an interaction with the color-forming compound. Further, the electron-accepting color-developing agent has an action to donate a proton to the leuco dye which is the electron-donating color-forming agent, thereby developing a color.

Examples of the color-developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole and derivatives thereof.

It is preferred to use the color-developing agent in an amount of from 0.5 to 10 parts, particularly from 1 to 5 parts, per part of the leuco dye. If the amount thereof is less than 0.5 part, the density of the developed color is decreased, and if the amount thereof exceeds 10 parts, it becomes difficult to completely erase the color.

(Decoloring Agent)

The decoloring agent used in this embodiment in a three-component system of a leuco dye (a color-forming compound), a color-developing agent and a decoloring agent may include a known compound as long as the compound inhibits the coloring reaction between the leuco dye and the color-developing agent through heating, thereby making the system colorless.

As the decoloring agent, a decoloring agent, which can form a coloring and decoloring system utilizing the temperature hysteresis of a decoloring agent disclosed in JP-A 60-264285, JP-A 2005-1369 and JP-A 2008-280523, has a particularly excellent instantaneous erasing property. When a mixture of such a three-component system in a colored state is heated to a specific decoloring temperature Th or higher, the mixture can be decolored. Further, even if the decolored mixture is cooled to a temperature below Th, the decolored state is maintained. When the temperature of the system is further decreased, a coloring reaction between the leuco dye and the color-developing agent is restored at a specific color restoring temperature Tc or lower, and the system returns to a colored state. In this manner, it is possible to cause a reversible coloring and decoloring reaction. In particular, it is preferred that the decoloring agent used in this embodiment satisfies the following relation: Th>Tr>Tc, wherein Tr represents room temperature.

Examples of the decoloring agent capable of causing such a temperature hysteresis include alcohols, esters, ketones, ethers and acid amides.

Particularly preferred are esters. Specific examples thereof include esters of carboxylic acids containing a substituted aromatic ring, esters of carboxylic acids containing an unsubstituted aromatic ring with aliphatic alcohols, esters of carboxylic acids containing a cyclohexyl group in each molecule, esters of fatty acids with unsubstituted aromatic alcohols or phenols, esters of fatty acids with branched aliphatic alcohols, esters of dicarboxylic acids with aromatic alcohols or branched aliphatic alcohols, dibenzyl cinnamate, heptyl stearate, didecyl adipate, dilauryl adipate, dimyristyl adipate, dicetyl adipate, distearyl adipate, trilaurin, trimyristin, tristearin, dimyristin and distearin. These compounds can also be used by mixing two or more species thereof.

It is preferred to use the decoloring agent in an amount of from 1 to 500 parts, particularly from 4 to 99 parts, per part of the leuco dye. If the amount thereof is less than 1 part, it is difficult to exhibit a completely decolored state, and if the amount thereof exceeds 500 parts, the density of a developed color may be decreased.

According to a preferred embodiment, fine particles (or source particles to be aggregated) of the color material containing the above-described three components of a leuco dye, a color-developing agent and a decoloring agent, are used as cores and encapsulated. Examples of an encapsulation method include an interfacial polymerization method, a coacervation method, an in-situ polymerization method, a submerged drying method and a submerged curing coating method.

In particular, an in-situ polymerization method in which a melamine resin is used as a shell component, an interfacial polymerization method in which a urethane resin is used as a shell component, etc. are preferably used.

In the case of an in-situ polymerization method, first, the above-mentioned three components are dissolved and mixed, and then, the resulting mixture is emulsified in an aqueous solution of a water-soluble polymer or a surfactant. Thereafter, an aqueous solution of a melamine formalin prepolymer is added thereto, followed by heating to effect polymerization, whereby encapsulation can be achieved.

In the case of an interfacial polymerization method, the above-mentioned three components and a polyvalent isocyanate prepolymer are dissolved and mixed, and then, the resulting mixture is emulsified in an aqueous solution of a water-soluble polymer or a surfactant. Thereafter, a polyvalent base such as a diamine or a diol, is added thereto, followed by heating to effect polymerization, whereby encapsulation can be achieved.

In this manner, it is possible to obtain an aqueous dispersion liquid of encapsulated fine particles (or source particles to be aggregated) of the color material having a volume-based median particle diameter as measured by a laser method (measurement particle diameter rage: 0.01-300 μm) of from 0.5 to 3.5 μm, preferably from 1.0 to 3.0 μm, and having a sharp particle size distribution. As described above, by encapsulating the fine particles of the erasable color material, the three components of a leuco dye (a color-forming compound), a color-developing agent and a decoloring agent constituting the fine particles of the color material are caused to be present in close contact with each other in each capsule, and a binder resin is not interposed therebetween. Accordingly, a coloring-decoloring system which achieves quick conversion between a colored state in which the density is high and a decolored state is formed.

(Release Agent)

In the toner of this embodiment, a release agent can be incorporated as needed. Examples of the release agent include aliphatic hydrocarbon-based waxes, such as low-molecular weight polyethylenes, low-molecular weight polypropylenes, polyolefin copolymers, polyolefin waxes, paraffin waxes and Fischer-Tropsch waxes, and modified products thereof; vegetable waxes, such as candelilla wax, carnauba wax, Japan wax, jojoba wax and rice wax; animal waxes, such as beeswax, lanolin and spermaceti wax; mineral waxes, such as montan wax, ozokerite and ceresin; fatty acid amides, such as linoleic acid amide, oleic acid amide and lauric acid amide; functional synthetic waxes; and silicone-based waxes.

In this embodiment, it is particularly preferred that the release agent has an ester bond between an alcohol component and a carboxylic acid component. Examples of the alcohol component include higher alcohols, and examples of the carboxylic acid component include saturated fatty acids having a linear alkyl group; unsaturated fatty acids, such as monoenoic acid and polyenoic acid; and hydroxy fatty acids. Further examples of the carboxylic acid component include unsaturated polyvalent carboxylic acids, such as maleic acid, fumaric acid, citraconic acid and itaconic acid. Further, an anhydride thereof can also be used.

From the viewpoint of low-temperature fixability, the softening point of the release agent may be from 50° C. to 120° C., more preferably from 60° C. to 110° C.

According to a preferred embodiment, the release agent is preferably supplied as a mixture with a binder resin in the form of dispersed fine particles (or source particles to be aggregated) having a volume-based median particle diameter as measured by a laser method (measurement particle diameter rage: 0.01-300 μm) of from 50 to 500 nm. The binder resin is used as needed, and it is preferred to use the release agent such that the total amount of the release agent and the binder resin may be from 1 to 99 parts, particularly from 2 to 19 parts, per part of the dispersed fine particles of the color material in the final toner.

(Charge Control Agent)

In this embodiment, in the binder resin, a charge control agent, etc. for controlling a triboelectric chargeability may be blended. As the charge control agent, metal-containing azo compounds may be used, among which a complex or a complex salt containing iron, cobalt or chromium as the metal element, or a mixture thereof is preferred. Further, metal-containing salicylic acid derivative compounds can also be used, among which a complex or a complex salt containing zirconium, zinc, chromium or boron as the metal element, or a mixture thereof, is preferred.

Fine particles containing the above-described binder resin, release agent, charge control agent, etc. can be formed by a method described in JP-A 2010-191430, such as a method in which these components are melt-kneaded, and if necessary the melt-kneaded material is coarsely crushed, and thereafter the resulting material is pulverized by ejecting the mixture from a high-pressure pump through a nozzle or an emulsion polymerization method.

(Reactive Polymer)

As a major component of the toner according to this embodiment, a reactive polymer having an oxazoline group capable of crosslinking with a polyester resin having a carboxyl group as the toner binder resin is used. It is necessary to perform crosslinking at a temperature below the decoloring temperature, and therefore, a polymer capable of crosslinking at a temperature ranging from room temperature to about 80° C. is preferred. According to a preferred embodiment, the reactive polymer having an oxazoline group is added before or after, preferably after, the aggregates are formed in an aqueous dispersion medium from the dispersed fine particles of the color material and the dispersed fine particles comprising at least a binder resin comprising a polyester resin, and is subjected to a crosslinking reaction with the polyester resin. Therefore, the reactive polymer is preferably soluble in water, and a polymer in which an oxazoline group has been attached to the main chain of a polymer, which imparts water solubility, e.g., the main chain of a homopolymer or a copolymer of an unsaturated fatty acid, such as acrylic acid or methacrylic acid, is preferably used. Examples of the commercially available product include "EPOCROS WS-500" and "EPOCROS WS-700", made by Nippon Shokubai Co., Ltd.

In consideration of the improved confinement of the fine particles of the color material and the storage stability of the toner, it is preferred to use such a reactive polymer having an oxazoline group in an amount of from 0.3 to 10.0 parts, particularly from 0.5 to 5.0 parts (based on the effective component of the reactive polymer having an oxazoline group), per 100 parts of the polyester-based binder resin.

(Aggregating Agent)

By adding an aggregating agent, dispersed solid fine particles including the dispersed fine particles of the color material, which are preferably encapsulated, and the dispersed fine particles comprising at least the binder resin comprising a polyester resin (further, the reactive polymer having an oxazoline group if being added before aggregation) may be aggregated in an aqueous dispersion medium preferably in the presence of a surfactant. At this time, it is preferred to set a solid content concentration in the aqueous dispersion liquid to 10 to 50%, particularly 20 to 30%. If the aggregating agent is added, it is preferred to add the aggregating agent by adjusting the temperature of the aqueous dispersion liquid to about 20° C. to 50° C.

Preferred examples of the aggregating agent may include organic aggregating agents, such as cationic surfactants in the form of a quaternary salt and polyethyleneimine; inorganic metal salts, such as sodium sulfate, sodium chloride, calcium chloride, calcium nitrate, magnesium chloride, magnesium sulfate, calcium nitrate, zinc chloride, ferric chloride, ferric sulfate, aluminum sulfate and aluminum chloride, and also inorganic metal salt polymers, such as poly(aluminum chloride) and poly(aluminum hydroxide); inorganic ammonium salts, such as ammonium sulfate, ammonium chloride and ammonium nitrate; and divalent or higher polyvalent metal complexes.

It is preferred to use the aggregating agent in an amount of from 3 to 40 parts, particularly from 5 to 30 parts, per 100 parts of the solid content including the fine particles of the color material and the fine particles comprising the binder resin. If the amount of the aggregating agent is less than 3 parts, an aggregation ability may be insufficient, and if the amount thereof exceeds 40 parts, coarse particles may be generated during aggregation, or the chargeability of the resulting toner may be deteriorated.

(Aggregation)

Aggregation is performed by adding the above-described aggregating agent to the aqueous dispersion liquid containing the dispersed fine particles of the color material and the dispersed fine particles comprising the binder resin comprising a polyester resin (and the release agent) (further, the reactive polymer having an oxazoline group) under stirring, and maintaining the temperature of the dispersion liquid at about 25 to 50° C.

Further, it is preferred that before adding the reactive polymer having an oxazoline group which will be described later, a dispersion liquid of resin fine particles comprising only a binder resin, or also comprising a charge control agent or a wax as needed, may be added to form the aggregates having a resin layer of the binder resin on the surfaces thereof (to effect encapsulation). The binder resin used for the encapsulation preferably comprises a polyester resin. The above-described color material is liable to be exposed on the surface of the aggregate, and by adding the resin fine particles in this manner, the confinement of the color material in the toner can be improved. Such a resin fine particle comprises a fine particle having a smaller particle diameter than the color material and does not comprise the color material. In such a resin fine particle, a wax, etc. can be incorporated as needed, but from the viewpoint of improvement of the confinement of the color material, the resin fine particle preferably comprises only a resin.

(Reaction and Fusion)

After aggregation of the dispersed fine particles of the color material and the dispersed fine particles comprising the binder resin is performed as described above, the reactive polymer having an oxazoline group is added, and further if necessary, a fusion-stabilizing agent such as an aqueous solution of sodium polycarboxylate is added. Thereafter, the temperature is gradually raised to the glass transition temperature of the binder resin to about 90° C., preferably under stirring, whereby a crosslinking reaction between the carboxyl group of the polyester resin as the binder resin and the oxazoline group of the reactive polymer having an oxazoline group in the aggregated particles is caused, and fusion of the aggregated particles is accelerated. When the fusion temperature exceeds the completely erasing temperature of the color material, the color-forming property is lost and it becomes necessary to cool the particles again, so that the fusion temperature is preferably lower than the completely erasing temperature of the color material. In order to effectively perform the crosslinking and fusion, it is preferred to maintain the temperature within a range of from 50 to 90° C. for 0.5 to 5 hours. Subsequently, the aggregated and fused particles are washed with water and dried, whereby decolorable toner particles having a volume-based median particle diameter as measured by a Coulter counter method (measurement particle diameter rage: 1.0-30 μm) of 5.0 μm to 20 μm, are obtained.

Incidentally, the crosslinking reaction between the carboxyl group of the polyester resin and the oxazoline group of the reactive polymer having an oxazoline group can be identified by analyzing a resultant amide bond. More specifically, the presence of an amide bond can be determined by, for example, the presence of a C═O or C═N stretching vibration absorption peak at around 1650 $cm^{-1}$ through an infrared analysis (IR).

(External Additive)

In this embodiment, in order to adjust the fluidity or chargeability of the toner particles obtained as described above, inorganic fine particles may be mixed with the toner particles to effect external addition in an amount of from 0.01 to 20% based on the amount of the toner particles. As such inorganic fine particles, silica, titania, alumina, strontium titanate, tin oxide, etc. can be used alone or in admixture of two or more species thereof. It is preferred that as the inorganic fine particles, those surface-treated with a hydrophobizing agent are used from the viewpoint of improvement of environmental stability. Further, other than such inorganic oxides, resin fine particles having a size of 1 μm or smaller can be externally added for improving the cleaning property.

EXAMPLES

Hereinafter, embodiments will be more specifically described with reference to Examples and Comparative Examples.

(Production of Amorphous Polyester Resin A)

The air in a four-necked flask equipped with a nitrogen inlet tube, a de-watering conduit, a stirrer and a thermocouple was replaced with nitrogen, and 4900 g of polyoxypropylene (2.2)-2,2-bis(4-hydroxyphenyl)propane, 1950 g of polyoxyethylene(2.0)-2,2-bis(4-hydroxyphenyl)propane, 2088 g of fumaric acid, 292 g of adipic acid, 10 g of tert-butylcatechol and 50 g of tin octylate were placed therein. The temperature of the contents was raised to 210° C. in a nitrogen atmosphere, and a reaction was allowed to proceed at 210° C. Then, a condensation reaction was allowed to proceed under reduced pressure at 8.3 KPa until a desired softening point was reached, whereby Amorphous polyester resin A was obtained. The obtained Amorphous polyester resin A had a softening point of 91° C., a glass transition point of 51° C. and an acid value of 16 mgKOH/g.

(Production of Amorphous Polyester Resin B)

The air in a four-necked flask equipped with a nitrogen inlet tube, a de-watering conduit, a stirrer and a thermocouple was replaced with nitrogen, and 4900 g of polyoxypropylene (2.2)-2,2-bis(4-hydroxyphenyl)propane, 1950 g of polyoxyethylene(2.0)-2,2-bis(4-hydroxyphenyl)propane, 1728 g of fumaric acid, 672 g of adipic acid, 384 g of trimellitic anhydride, 10 g of tert-butylcatechol and 50 g of tin octylate were placed therein. The temperature of the contents was raised to 210° C. in a nitrogen atmosphere, and a reaction was allowed to proceed at 210° C. Then, a condensation reaction was allowed to proceed under reduced pressure at 8.3 KPa until a desired softening point was reached, whereby Amorphous polyester resin B was obtained. The obtained Amorphous polyester resin B had a softening point of 102° C., a glass transition point of 51° C. and an acid value of 33 mgKOH/g.

(Production of Toner Binder Resin Dispersion Liquid A)

In a 5 L-stainless steel vessel, 390 g of Amorphous polyester resin A, 210 g of Amorphous polyester resin B, 40 g of an anionic surfactant "Neopelex G-15 (made by Kao Corporation)" (sodium dodecyl benzene sulfonate) (solid content: 15 wt. %), 6 g of a nonionic surfactant "Emulgen 430 (made by Kao Corporation)" (polyoxyethylene (26 mol) oleyl ether) and 218 g of an aqueous solution of 5 wt. % potassium hydroxide were dispersed at 25° C. under stirring at 200 rpm, followed by raising the temperature to 90° C. The contents were stabilized at 90° C. and maintained for 2 hours under stirring. Subsequently, 1076 g of deionized water was added dropwise thereto at 6 g/min, whereby an emulsified material was obtained. After being cooled, the emulsified material was passed through a metal mesh, whereby Toner binder resin dispersion liquid A was obtained. The volume-based median particle diameter of the resin fine particles in the obtained Toner binder resin dispersion liquid A was 0.16 μm and the solid content concentration therein was 32 wt. %.

(Production of Release Agent Dispersion Liquid)

In a 1 L-beaker, 480 g of deionized water and 4.3 g of an aqueous solution of dipotassium alkenylsuccinate (trade name: Latemul ASK, made by Kao Corporation, effective concentration: 28 wt. %) were placed, and 120 g of carnauba wax was dispersed therein. The resulting dispersion liquid was treated with an ultrasonic homogenizer (trade name: US-600T, made by Nihonseiki Kaisha Ltd.) for 30 minutes while maintaining the temperature of the dispersion liquid at 90 to 95° C. After the dispersion liquid was cooled, deionized water was added thereto to adjust the solid content to 20 wt. %, whereby Release agent dispersion liquid was obtained. The volume-based median particle diameter of the release agent in Release agent dispersion liquid was 0.42 μm.

Example 1

In order to form a color material, 5 parts of Crystal Violet Lactone (CVL) as a leuco dye, 5 parts of benzyl 4-hydroxybenzoate as a color-developing agent and 50 parts of 4-benzyloxyphenylethyl laurate as a discoloration temperature-controlling agent (decoloring agent) were melted by heating. The resulting melted materials were poured into 250 parts of an aqueous solution of 8% polyvinyl alcohol together with a solution obtained by mixing 20 parts of an aromatic polyvalent isocyanate prepolymer and 40 parts of ethyl acetate as encapsulating agents, and the resulting mixture was emulsified and dispersed. After stirring was continued at 70° C. for about 1 hour, 2 parts of a water-soluble aliphatic modified amine was added thereto as a reaction agent, and stirring was further continued for about 3 hours while maintaining the temperature of the liquid at 90° C., whereby colorless capsule particles were formed. Further, the resulting dispersion of the capsule particles was placed in a freezer (at −30° C.) to develop a color, whereby a dispersion of blue colored particles was obtained. The volume-based median particle diameter of the resulting colored particles was measured using "SALD-7000", made by Shimadzu Corporation and found to be 2 μm. Further, the colored particles showed a completely decoloring temperature Th of 79° C. and a completely coloring temperature Tc of −20° C.

The completely decoloring temperature refers to a temperature at which the density of an image in a completely decolored state (a state in which the color-forming compound and the color-developing agent are not coupled with each other and therefore coloring due to the coupling is not caused) is exhibited. Meanwhile, the completely coloring temperature refers to a temperature at which the density of an image in a completely colored state (a state where the density of an image becomes almost the maximum when using a toner having the composition) is exhibited.

100 Parts of the dispersion liquid containing 10 parts of the above encapsulated color material, 283 parts of Toner binder resin dispersion liquid A (containing 85 parts of the resin component) and 25 parts of Release agent dispersion liquid (containing 5 parts of the release agent component) were mixed, and further 164 parts of an aqueous solution of 11% ammonium sulfate [$(NH_4)_2SO_4$] was added thereto to effect aggregation, whereby a toner particle dispersion liquid was prepared. Thereafter, an aqueous solution of an oxazoline group-containing acrylic polymer ("EPOCROS WS-700", made by Nippon Shokubai Co., Ltd. polymer content: 25%) was added thereto so as to provide a ratio of the polymer content to the solid content in the toner of 7.2%. Then, 250 parts of a 2.5 wt. % aqueous solution of an anionic surfactant ("EMAL E-27C", made by Kao Corporation) was added thereto, and the temperature was raised to 65° C. and maintained for 2 hours, whereby a toner dispersion liquid was prepared. After being cooled, the toner particles were collected from the dispersion liquid through de-watering, washing and drying. The volume-based median particle diameter of the collected toner particles measured using a Coulter counter (aperture diameter: 50 μm, measurement particle diameter range: 1.0 to 30 μm) was 6.6 μm.

3.5 Parts of hydrophobic silica ("NAX50", made by Japan Aerosil Co., Ltd.) and 0.5 part of titanium oxide ("NKT90" made by Japan Aerosil Co., Ltd.) were mixed with 100 parts of the obtained toner particles to effect external addition, whereby a toner of Example 1 was obtained.

Example 2

A toner was prepared in the same manner as in Example 1 except that the addition amount of "EPOCROS WS-700" in Example 1 was changed so as to provide a ratio of the polymer content to the solid content in the toner of 10.4%.

Example 3

A toner was prepared in the same manner as in Example 1 except that the addition amount of "EPOCROS WS-700" in Example 1 was changed so as to provide a ratio of the polymer content to the solid content in the toner of 4.8%.

Example 4

100 Parts of a dispersion liquid containing 10 parts of an encapsulated color material prepared in the same manner as in Example 1, 190 parts of Toner binder resin dispersion liquid A (containing 57 parts of the resin component) and 25 parts of Release agent dispersion liquid (containing 5 parts of the release agent component) were mixed, and further 164 parts of an aqueous solution of 11% ammonium sulfate [$(NH_4)_2SO_4$] was added thereto to effect aggregation, whereby a core particle dispersion liquid was prepared. Further, 93 parts of Toner binder resin dispersion liquid A (containing 28 parts of the resin component) for forming a shell was added thereto at 50° C. and the resulting mixture was maintained as such for 3 hours, whereby an encapsulated toner dispersion liquid was prepared. Thereafter, an aqueous solution of an oxazoline group-containing acrylic polymer ("EPOCROS WS-700", made by Nippon Shokubai Co., Ltd.; polymer content: 25%) was added thereto so as to provide a ratio of the polymer content to the solid content in the toner of 3.8%. Then, 250 parts of a 2.5 wt. % aqueous solution of an anionic surfactant ("EMAL E-27C", made by Kao Corporation) was added thereto, and the temperature was raised to 65° C. and maintained for 2 hours, whereby a toner was prepared. Thereafter, in the same manner as in Example 1, the toner particles were collected through de-watering, washing and drying, and hydrophobic silica and titanium oxide were externally added to the toner particles, whereby an encapsulated toner was obtained. The volume-based median particle diameter of the thus obtained toner measured in the same manner as in Example 1 was 7.2

Example 5

100 Parts of a dispersion liquid containing 10 parts of an encapsulated color material prepared in the same manner as in Example 1, 190 parts of Toner binder resin dispersion liquid A (containing 57 parts of the resin component) and 25 parts of Release agent dispersion liquid (containing 5 parts of the release agent component) were mixed, and further 164 parts of an aqueous solution of 11% ammonium sulfate [$(NH_4)_2SO_4$] was added thereto to effect aggregation, whereby a core particle dispersion liquid was prepared. Further, 93 parts of Toner binder resin dispersion liquid A (containing 28 parts of the resin component) for forming a shell was added thereto at 50° C. and the resulting mixture was maintained as such for 3 hours, whereby an encapsulated toner dispersion liquid was prepared. Thereafter, an aqueous solution of an oxazoline group-containing acrylic polymer ("EPOCROS WS-700", made by Nippon Shokubai Co., Ltd.; polymer content: 25%) was added thereto so as to provide a ratio of the polymer content to the solid content in the toner of 2.8%. Then, 250 parts of a 2.5 wt. % aqueous solution of an anionic surfactant ("EMAL E-27C", made by Kao Corporation) was added thereto, and the temperature was raised to 65° C. and maintained for 2 hours, whereby an encapsulated toner dispersion liquid was prepared. Thereafter, in the same manner as in Example 1, the toner particles were collected through de-watering, washing and drying, and hydrophobic silica and titanium oxide were externally added to the toner particles, whereby an encapsulated toner was obtained. The volume-based median particle diameter of the thus obtained toner measured in the same manner as in Example 1 was 7.0 μm.

Comparative Example 1

A toner was prepared in the same manner as in Example 1 except that a toner dispersion liquid was formed by raising the temperature of the dispersion liquid of the aggregated toner particles to 65° C. without adding "EPOCROS WS-700" which was added in Example 1.

The toners obtained in the above Examples and Comparative Example were evaluated with respect to the following items.

(Toner Fine Powder)

The particle diameter of each toner after being subjected to washing, drying and external addition was measured using a Coulter particle size analyzer with an aperture diameter of 50 μm (measurement particle diameter range: 1.0 to 30 μm). The value of a cumulative number % in the range of from 1.0 μm to 2.0 μm in the number-based distribution was adopted.

(Storage Stability of Toner)

20.0 g of each toner after being subjected to external addition was immersed in hot water at 50° C. for 8 hours, and then shaken for 10 seconds using "Powder Tester", made by Hosokawa Micron Corporation. Thereafter, the ratio (wt. %) of the amount of the aggregated toner remaining on a sieve (42 mesh, opening: 0.351 mm) was used as an index of the storage stability of the toner. The outlines of the above Examples and Comparative Example and the evaluation results are summarized and shown in the following Table 1.

TABLE 1

| | Example 1 | Example 2 | Example 3 | Example 4 | Example 5 | Comparative Example 1 |
|---|---|---|---|---|---|---|
| With or without encapsulation of toner | Without | Without | Without | With | With | Without |
| Addition amount of oxazoline group-containing polymer (wt. %) | 7.2 | 10.4 | 4.8 | 3.8 | 2.8 | None |
| Toner fine powder (number % in range of from 1 to 2 μm) | 8.5 | 5.2 | 10.0 | 4.5 | 6.5 | 35.2 |
| Volume-based median particle diameter of toner (μm) | 6.6 | 7.5 | 5.8 | 7.2 | 7.0 | 6.2 |
| Storage stability of toner (wt. % on sieve) | 0.5 | 0.4 | 0.7 | 0.5 | 0.8 | 46.3 |

From the results shown in the above Table 1, it was found that by treating toner particles with an oxazoline group-containing polymer, not only was the storage stability of a toner improved, but also the confinement of fine particles of a color material of a decolorable toner in toner particles was significantly improved, although the confinement in a toner had been particularly difficult due to the microencapsulation (Comparative Example 1). It was also found that the generation of toner fine powder was suppressed (Examples 1 to 3). Further, it was found that by encapsulating toner particles with a shell material composed mainly of a binder resin prior to the treatment with an oxazoline group-containing polymer, even by the treatment with a small amount of the oxazoline group-containing polymer, the confinement of microencapsulated fine particles of a color material of a decolorable toner in the toner was further improved (Examples 4 and 5).

In each of the toners of the above Examples, the completely decoloring temperature of the color material is 79° C., and it is necessary to perform fixing at a temperature below 79° C. The enhancement of the mechanical strength of the toner by crosslinking increases the molecular weight of the resin and also increases the fixing temperature. Therefore, in order to form a toner which can be fixed at a low temperature in a colored state, it is preferred that crosslinking is caused only in a shell region, i.e., on a surface of the toner and in a region proximate to the surface thereof without causing a crosslinking reaction in the inside of the toner, i.e., in the aggregated particles. Accordingly, as in the case of Examples 4 and 5, it is preferred that after forming aggregated particles, the entire surface of each aggregated particle is coated with a thin layer of polyester resin particles, and thereafter a crosslinking reaction is caused.

Although depending on the completely erasing temperature of the color material, it is difficult to increase the completely erasing temperature of the color material and to sufficiently increase the difference between the coloring temperature and the erasing temperature due to restrictions on materials. In view of this, it is preferred that the erasing temperature is set to 85 to 120° C., the fixing temperature is set to about 85 to 70° C., and the difference between the erasing temperature and the fixing temperature is set to 10° C. or more. For a toner required to have low-temperature fixability as described above, it is particularly important to perform crosslinking only in a surface region as in the case of Examples 4 and 5.

Each of the toners of Examples 1 to 5 was placed in an MFP ("e-STUDIO 3520c", made by Toshiba Tec Corporation) modified for evaluation, and an unfixed image was formed. Then, in a fixing device (30 mm/s) modified for evaluation, the fixing temperature was set to 75° C. and the erasing temperature was set to 85° C., and fixing and erasing of the toner were performed. As a result, each toner showed sufficient fixability and erasability.

FIG. 1 is a schematic arrangement view showing an overall organization of an image forming apparatus to which a developer according to this embodiment is applicable.

As illustrated, a color image forming apparatus of a four-drum tandem type (MFP) 1 is provided with a scanner section 2 and a paper discharge section 3 at an upper section thereof.

The color image forming apparatus 1 has an image forming unit 11 below an intermediate transfer belt 10. The image forming unit 11 includes four sets of image forming units 11Y, 11M, 11C and 11E arranged in parallel along the intermediate transfer belt 10. The image forming units 11Y, 11M, 11C and 11E form yellow (Y), magenta (M), cyan (C) and decolorable (or erasable) blue (E) toner images, respectively.

The color image forming apparatus 1 has three image forming modes including (1) a mode of forming images using developers selected from three colors Y, M and C, (2) a mode of forming images using developers of Y, M and C and a decolorable toner, and (3) a mode of forming images using only a decolorable toner, and effects image formation by selecting any one of these modes. The evaluation of the fixability of decolorable toners in the above-mentioned Examples, image formation was performed by selecting the mode (3) of forming images using only a decolorable toner and operating only the image forming unit 11E The image forming units 11Y, 11M, 11C and 11E have photosensitive drums 12Y, 12M, 12C and 12E, respectively, as image-bearing members, respectively. Each of the photosensitive drums 12Y, 12M, 12C and 12E rotates in the direction of an arrow m. Around the photosensitive drums 12Y, 12M, 12C and 12E, electric chargers 13Y, 13M, 13C and 13E, developing devices 14Y, 14M, 14C and 14E and photosensitive drum cleaners 16Y, 16M, 16C and 16E, for the respective drums, are disposed along the rotational direction.

Between each of the electric chargers 13Y, 13M, 13C and 13E and each of the developing devices 14Y, 14M, 14C and 14E, the photosensitive drums 12Y, 12M, 12C and 12E, light are irradiated with light from a laser exposing device (latent image forming device) 17 to form electrostatic latent images on the photosensitive drums 12Y, 12M, 12C and 12E.

The developing devices 14Y, 14M, 14C and 14E supply toners on the latent images on the photosensitive drums 12Y, 12M, 12C and 12E.

An intermediate transfer belt 10 is disposed under tension around a backup roller 21, a driven roller 20 and first to third tension rollers 22 to 24 and is rotated in the direction of an arrow S. The intermediate transfer belt 10 faces and is in contact with the photosensitive drums 12Y, 12M, 12C and 12E. At the positions where the intermediate transfer belt 10 faces the photosensitive drums 12Y, 12M, 12C and 12E, primary transfer rollers 18Y, 18M, 18C and 18E are provided, respectively. The primary transfer rollers 18Y, 18M, 18C and 18E are electroconductive rollers and supply primary transfer bias voltages to respective transfer sections.

A secondary transfer roller 27 is disposed to face a secondary transfer section of the intermediate transfer belt 10 supported by the backup roller 21. At the secondary transfer section, a predetermined secondary transfer bias is applied to the backup roller 21 which is an electroconductive roller. When a paper sheet P (P1 or P2) passes between the intermediate transfer belt 10 and the secondary transfer roller 27, the toner image on the intermediate transfer belt 10 is secondarily transferred to the paper sheet P. After the secondary transfer, the intermediate transfer belt 10 is cleaned by a belt cleaner 10*a*.

Below the laser exposure device 17 is disposed a paper feed cassette 4 for supplying paper sheets toward the secondary transfer roller 27. On the right side of the color image forming apparatus 1 is disposed a manual paper feed mechanism for feeding paper sheets manually supplied.

Along the path from the paper feed cassette 4 to the secondary transfer roller 27, a pickup roller 4*a*, a separation roller 28*a* and 28*b*, conveying rollers 28*b* and a resist roller pair 36 are provided to form a paper feed mechanism. Along the path from a manual feed tray 31*a* of the manual feed mechanism 31 to the resist roller pair 36, a manual feed pickup roller 31*b* and a manual feed separation roller 31*c* are provided.

Further, along a vertical conveying path 34 for conveying paper sheets in a direction of from the paper feed cassette 4 or the manual feed tray 31*a* to the secondary transfer roller 27, a media sensor 39 is disposed for detecting the type of fed paper sheets. The color image forming apparatus 1 is composed to be able to control the speed of conveying paper sheets, transfer condition, fixing condition, etc., based on the detection result given by the media sensor 39. Further, a fixing device 30 is provided downstream of the secondary transfer section along the vertical conveying path 34. Paper sheets taken out of the paper feed cassette 4 or supplied from the manual feed mechanism 31 are conveyed along the vertical conveying path 34, through the resist roller pair 36 and the secondary transfer roller 27 to the fixing device 30. The fixing device 30 includes a fixing belt 53 wound about a pair of a heating roller 51 and a drive roller 52, and a mating roller 54 disposed opposite to the heating roller 51 via the fixing belt 53. A paper sheet carrying a toner image transferred at the secondary transfer section is conveyed to between the fixing belt 53 and the mating roller 54 for being heated by the heating roller 51 to fix the toner image onto the paper sheet. Downstream of the fixing device 30, a gate 33 which guides the paper sheet P to either a paper discharge roller 41 or a reconveying unit 32 is provided. A paper sheet P guided to the paper discharge roller 41 is discharged to a paper discharge section 3. A paper sheet P guided to the reconveying unit 32 is guided to the secondary transfer roller 27 again.

The image forming section 11E integrally includes the photosensitive drum 11 and process means and is disposed to be freely attached to and detached from the main assembly of the color image forming apparatus 1. The image forming sections 11*y*, 11M and 11C also have similar structures as the section 11. The color image forming apparatus 1 will be described in more detail with reference to FIGS. 2 to 5.

Figure 2:
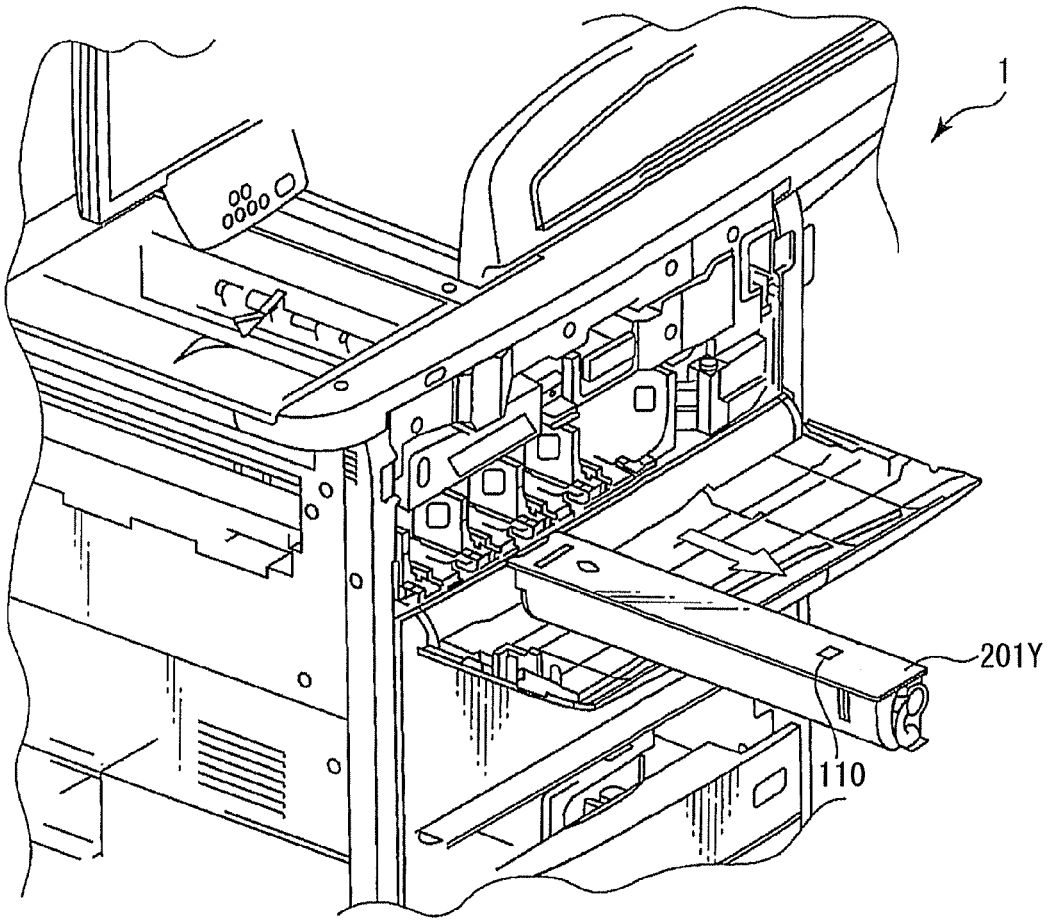
FIG. 2 is a partial schematic view of an image forming apparatus for illustrating a positional relationship of process (or toner) cartridges with the apparatus.
Figure 3:
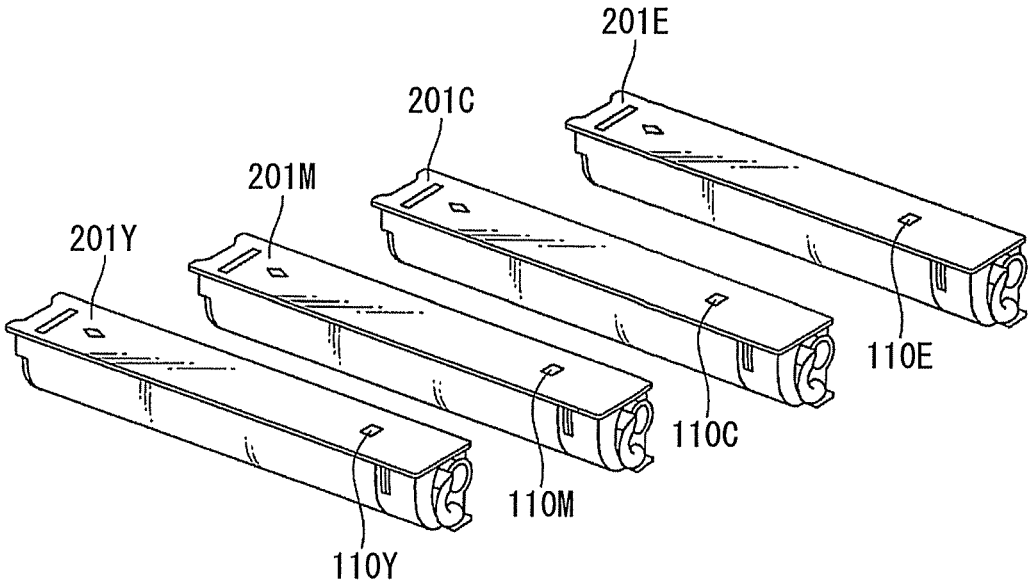
FIG. 3 is a schematic perspective view illustrating an arrangement of four color process (or toner) cartridges.

As shown in FIGS. 2 and 3, the color image forming apparatus 1 has toner cartridges 201Y, 201M, 201C, and 201E for supplying the toner of respective colors to the development devices 14Y, 14M, 14C, and 14E. The toner cartridges 201Y, 201M, 201C, and 201E are detachably mounted to the image forming apparatus 1. In order to achieve right matching with the development apparatus 14Y, 14M, 14C, and 14E, IC chips 110Y, 110M, 110C, and 110E having memorized each color information of the developers are provided to the toner cartridges of respective colors.

Figure 4:
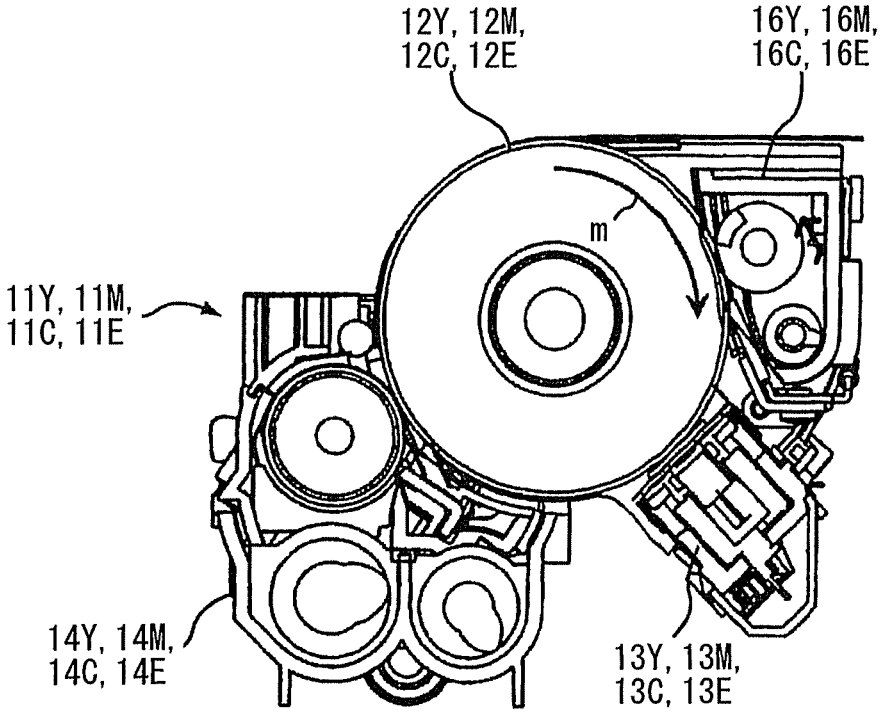
FIG. 4 is a sectional view illustrating a structure of a process unit (cartridge) including several process devices to be disposed surrounding a photosensitive drum.

FIG. 4 is a sectional view of the image forming sections 11Y, 11M, 11C, and 11E. If the image forming section 11E is taken for example, it is composed as a process unit (cartridge) including a photosensitive drum 12E, an electrification charger 13E, a developing device 14E, and a cleaning device 16E, combined integrally. The image forming sections 11Y, 11M, and 11C are also in similar structures.

Figure 5:
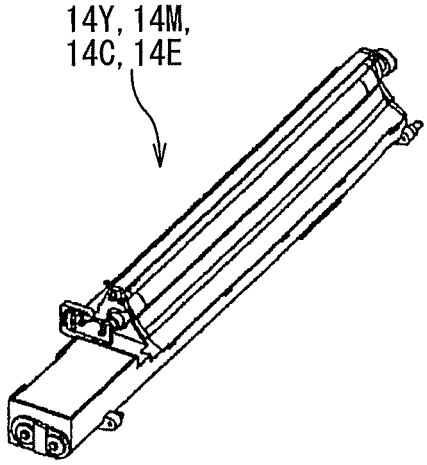
FIG. 5 is a perspective view of a process unit (cartridge) including only a developing device.

Incidentally, although FIG. 4 illustrates process units each including all the process means (devices) around the photosensitive drum are integrated, it is also possible to compose a developer cartridge including only a developing device 14Y, 14M, 14C, or 14E which is detachably mountable to a color image forming apparatus (MFP) 1 as shown in FIG. 5

While certain embodiments have been described, these embodiments have been presented by way of example only, and are not intended to limit the scope of the inventions. Indeed the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A process for production of a toner, comprising: aggregating encapsulated and dispersed particles of a color material including a color-forming compound, a color-developing agent and a decoloring agent with dispersed particles comprising at least a binder resin comprising a polyester resin to form aggregates in an aqueous medium, adding a reactive polymer having an oxazoline group reactive with a polyester resin into the aqueous medium to surface-treat the aggregates with the reactive polymer, thereby forming the aggregates comprising the polyester binder resin and the encapsulated particles of the color material and a crosslink coating on the aggregates, and fusing the aggregates in the aqueous medium.

2. The process according to claim 1, further comprising encapsulating the aggregates by adding dispersed particles comprising at least a binder resin to adhere to the aggregates, thereby coating the aggregates after forming the aggregates and before adding the reactive polymer having an oxazoline group.

3. The process according to claim 1, wherein the aggregation is performed at a temperature lower than the decoloring temperature of the particles of the color material.

4. A decolorable toner, comprising aggregates; the aggregates comprising at least a binder resin comprising a polyester resin, and encapsulated particles of a color material including a color-forming compound, a color-developing agent and a decoloring agent; wherein surface regions of the aggregates have been crosslinked by treatment with a reactive polymer having an oxazoline group reactive with the polyester resin.

5. The toner according to claim 4, wherein the surface regions of the aggregates before the crosslinking are composed only of the polyester resin.

6. The toner according to claim 4, wherein aggregates of the encapsulated particles of a color material including a color-forming compound, a color-developing agent and a decoloring agent with particles including at least a binder resin, have been treated with the reactive polymer having an oxazoline group reactive with a polyester resin to form the crosslink coating.

7. The toner according to claim 4, wherein the aggregates of the encapsulated particles of the color material with the particles comprising the binder resin, have been encapsulated with a shell material composed mainly of a binder resin comprising a polyester resin, and the polyester resin in the shell material has been crosslinked with the reactive polymer having an oxazoline group to form the crosslink coating.

* * * * *